US005216571A

United States Patent [19]

Ko

[11] Patent Number: 5,216,571

[45] Date of Patent: Jun. 1, 1993

[54] ANTISTATIC ROLL FOR USE IN FILM PRODUCTION FACILITIES

[75] Inventor: Hee-Young Ko, Suwon, Rep. of Korea

[73] Assignee: SKC Limited, Kyongi, Rep. of Korea

[21] Appl. No.: 832,221

[22] Filed: Feb. 7, 1992

[30] Foreign Application Priority Data

May 15, 1991 [KR] Rep. of Korea ..... 91-6887

[51] Int. Cl.[5] ..... H05F 3/00; H05F 3/02

[52] U.S. Cl. ..... 361/221; 361/220; 474/90

[58] Field of Search ..... 361/212, 214, 220, 221; 474/90, 188, 189; 198/842, 843; 271/208

[56] References Cited

U.S. PATENT DOCUMENTS

| | | | |
|---|---|---|---|
| 1,396,318 | 11/1921 | Bunger | 361/221 X |
| 2,207,677 | 7/1940 | Chapman | 361/220 X |
| 2,743,810 | 5/1956 | Armstrong | 198/843 |
| 3,248,775 | 5/1966 | Morrow | 474/189 X |
| 3,308,045 | 3/1967 | Sullivan | 361/221 X |
| 4,392,177 | 7/1983 | Geyken | 361/221 |
| 4,402,593 | 9/1983 | Bernard et al. | 361/221 X |
| 4,673,380 | 6/1987 | Wagner | 474/90 |
| 4,718,544 | 1/1988 | Herren | 198/843 |
| 4,999,733 | 3/1991 | Kakuda | 361/221 X |

FOREIGN PATENT DOCUMENTS

| | | | |
|---|---|---|---|
| 2124837 | 9/1979 | Fed. Rep. of Germany | 361/212 |
| 481707 | 3/1938 | United Kingdom | 474/189 |

*Primary Examiner*—A. D. Pellinen
*Assistant Examiner*—Fritz M. Fleming
*Attorney, Agent, or Firm*—Thomas J. Dodd

[57] ABSTRACT

An antistatic roll is provided for use in transferring and/or winding a continuous sheet of polymeric film. The roll comprises a cylindrical core made of an electrically conductive material which is provided with a pair of rotational shafts, each extending away from the opposite ends of the roll in an axial direction. A layer of dielectric material surrounds the core, which has a spiral groove formed on the outer circumference thereof at a substantially equal pitch. An elongate conductor is held within and extends along the spiral groove to gather static electricity from the roll and/or the polymeric film. Associated with the elongate conductor is a grounding arrangement to drain off the static electricity gathered therein.

5 Claims, 2 Drawing Sheets

ANTISTATIC ROLL FOR USE IN FILM PRODUCTION FACILITIES

FIELD OF THE INVENTION

The present invention relates generally to a roll adapted to transfer or wind a substantial length of polymeric film; and, more particularly to an antistatic roll of the type having an arrangement for removal of the electrostatic charges from the roll or the polymeric film being wound thereon.

DESCRIPTION OF THE PRIOR ART

As well known in the art, various different rolls have been employed in transferring or winding a continuous sheet of polymeric film, e.g., a film made of polyethyleneterephthalate(PET), polyvinylchloride(PVC), polypropylene(PP), polyethylene(PE), polyamide(nylon) and the like. These prior art rolls may be categorized into a group of conductive rolls that are made solely of electrically conductive material and another group of composite rolls that consist of a conductive core and a dielectric outer layer surrounding the core. When the polymeric film is transferred through the use of or wound around such rolls, a substantial amount of electrostatic charges is generated due largely to the frictional contact between the rotating roll and the moving film. In most cases, the electrostatic charges have a tendency to attract dirts or other particles present in the atomosphere, thus making the film quality poor.

While it is possible for the conductive roll to remove the electrostatic charges or static electricity simply by grounding the roll itself, such is not the case for the composite roll. Specifically, since the composite roll has a nonconductive outer layer, grounding the conductive core along is not sufficient to prevent the outer layer and hence the polymeric film from getting electrostatic.

One conventional approach employed to remove electrostatic charges is to install a separate and independent conduction device in the vicinity of the composite roll. This conduction device has, however, proven to be of limited efficacy owing to its structural and spatial restrictions. Another approach is to add an chemical agent to the polymeric film in order to render the latter antistatic. This has also been found to be less effective in attaining a desired level of antistatic effect. Furthermore, use of such an additive may adversely affect the physical properties of the polymeric film, resulting in a degraded film quality. A still another prior art approach proposes the use of a certain antistatic agent mixed with polymer materials, which are then processed to a polymeric film. Although this approach is somewhat effective in giving the polymeric film a certain degree of antistatic property, it still has the deficiency in that the use thereof is strictly confined to specific types of polymeric film.

Thus, needs have continued to exist in the art to find an improved solution for the removal of static electricity from electrostatically charged composite roll and/or polymeric film.

SUMMARY OF THE INVENTION

Accordingly, it is an object of the invention to provide an improved antistatic composite roll which substantially eliminates those disadvantages inherent in the prior art apparatus and which is capable of removing static electricity charged on various types of polymeric film and/or roll in an efficient manner.

In accordance with one aspect of the invention, there is provided an antistatic roll for use in selectively transferring and winding a continuous sheet of polymeric film, which comprises: a cylindrical core made of electrically conductive material, the core provided with a pair of rotational shafts, each extending away from the opposite ends of the core in an axial direction; a layer of electrically nonconductive material surrounding the core, the nonconductive layer having a spiral groove formed on the surface thereof at a substantially equal pitch; an elongate conductor held within and extending along the spiral groove so as to gather static electricity charged on the roll and/or the polymeric film; and means for grounding the elongate conductor to drain off the static electricity gathered therein.

Another aspect of the invention lies in an antistatic roll for use in selectively transferring and winding a continuous sheet of polymeric film, which comprises: a cylindrical core made of electrically conductive material, the core provided with a pair of rotational shafts, each extending away from the opposite ends of the core in an axial direction; a layer of electrically nonconductive material surrounding the core, the nonconductive layer having a first spiral groove provided on the surface thereof at a substantially equal pitch and a second spiral groove formed to intersect the first groove, thereby defining a plurality of rhombic island regions on the surface of the roll; a pair of elongate conductors held within and extending along each of the first and the second spiral grooves so as to gather static electricity charged on the roll and/or the polymeric film; and means for grounding the elongate conductors to drain off the static electricity gathered therein.

BRIEF DESCRIPTION OF THE DRAWINGS

The above and other objects and features of the present invention will become apparent from the following description given in conjuction with the accompanying drawings, in which.

DETAILED DESCRIPTION OF THE PREFERRED EMBODIMENTS

Figure 1:
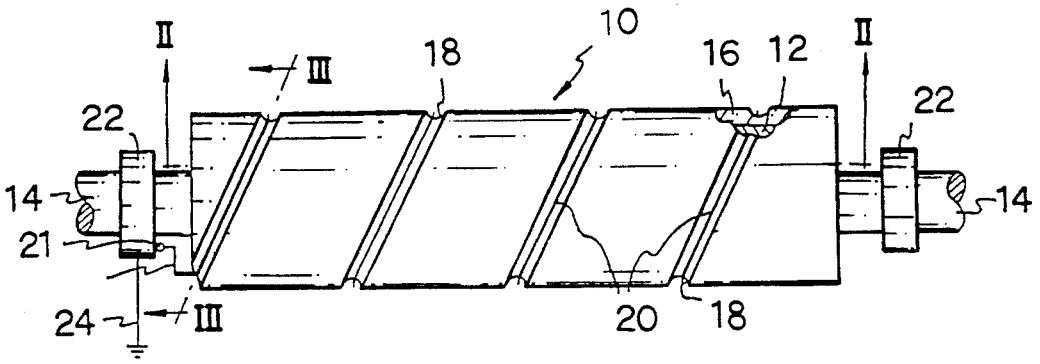
FIG. 1 is a front elevational view showing an embodiment of the antistatic composite roll in accordance with the invention.
Figure 2:
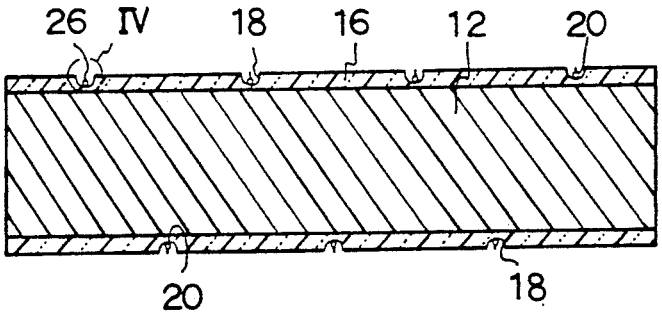
FIG. 2 is a cross-sectional view taken along line II—II of FIG. 1.

As shown in FIGS. 1 to 4, a composite roll 10 in accordance with one embodiment of the invention comprises a cylindrical core 12 made of electrically conductive material. This core 12 may be a hollow or solid metal cylinder that has a sufficient rigidity to function as a frame of the roll 10. It is known that the core 12 is provided with a pair of rotational shafts 14, each of which extends axially away from the opposite ends of the roll 10. An electrically nonconductive layer 16 of, e.g., rubber or silicon is wrapped or coated around the conductive core 12 in the form of a sleeve, thereby to make the circumferential surface of the roll 10 electrically nonconductive. The nonconductive or dielectric layer 16 serves to enhance the frictional engagement between the roll 10 and a continuous film of polymer(-not shown) as the polymeric film is transferred through the use of or wound around the roll 10 during the process of film production.

Formed on the circumferential surface of the nonconductive layer 16 is a spiral groove 18 that extends helically between the opposite ends of the roll 10 along an axial direction. It is desirable to form the spiral groove 18 with a pitch as small as possible in order to ensure a maximum removal of the static electricity present both on the polymeric film and the roll, although the exact pitch depends upon the diameter of a particular roll and the like. The spiral groove 18 is shown in the drawings to have a U-shaped configuration for the purpose of illustration. This is, however, not critical in the invention and other configurations may also be adaptable.

An elongate conductor 20, e.g., metal wire or strip, is held within and extends along the substantially entire length of the spiral groove 18. As best shown in FIG. 1, a partial length of the elongate conductor 20 is protruded outside the spiral groove 18 at one end of the roll 10 and then terminates at a movable contact 21. It can be seen that the shafts 14 of the roll 10 are rotatably supported by a pair of metal bearings 22, e.g., conductive oilless bearings. One of the bearings 22 acts as a stationary contact that cooperates with the movable contact 21 to provide an electrical connection between the elongate conductor 20 and the active bearing 22.

In order to ensure that the movable contact 21 be brought into positive contact with the active bearing 22 even when the roll 10 is in rotation, it may be necessary to have the movable contact 21 resiliently urged against the flank side of the active bearing 22. It is of importance that such a bearing 22 be grounded through a conductive wire 24 or other suitable conductive parts. The movable contact 21, the active bearing 22 and the conductive wire will constitute together means for grounding the elongate conductor 20 to drain off or discharge the static electricity present on the roll 10 and/or the polymeric film. If desired, the grounding means may be provided at the other end of the roll 10.

Figure 3:
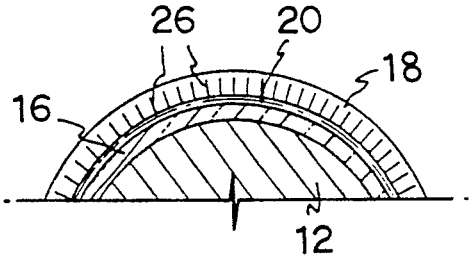
FIG. 3 is a cross-sectional view taken along line III—III of of FIG. 1, showing in more detail both the elongate conductor held in position along the spiral groove and the radial needles fixedly secured to the elongate conductor.
Figure 4:
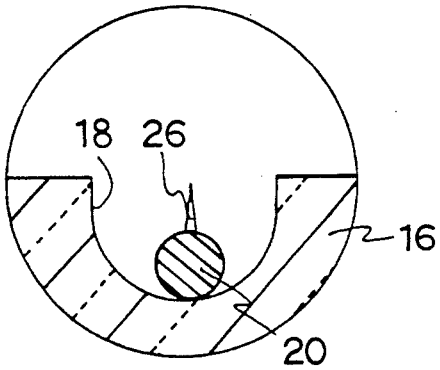
FIG. 4 is an enlarged view of the portion encircled and denoted by "IV" in FIG. 2.

As is apparent from FIGS. 3 and 4, the roll 10 may additionally include a multiplicity of conductive needles 26 that are fixedly secured to and substantially uniformly spaced along the elongate conductor 20. Each of the needles 26 extends outwardly along the radius of said roll 10 so as to efficiently gather the static electricity generated due to the frictional engagement of the roll 10 with the polymeric film. These needles 26 should not extend radially beyond the circumferential surface of the roll 10, which would otherwise be a cause of damaging the polymeric film. For the antistatic roll 10 to be manufactured in a convenient manner, it is desirable to first attach the needles 26 to the elongate conductor 20 prior to positioning the conductor 20 into the spiral groove 18. The antistatic roll of the type set forth above has the ability to drain off any electrostatic charges, thus making it possible to produce a good quality of the polymeric film with no or little static electricity left thereon.

Figure 5:
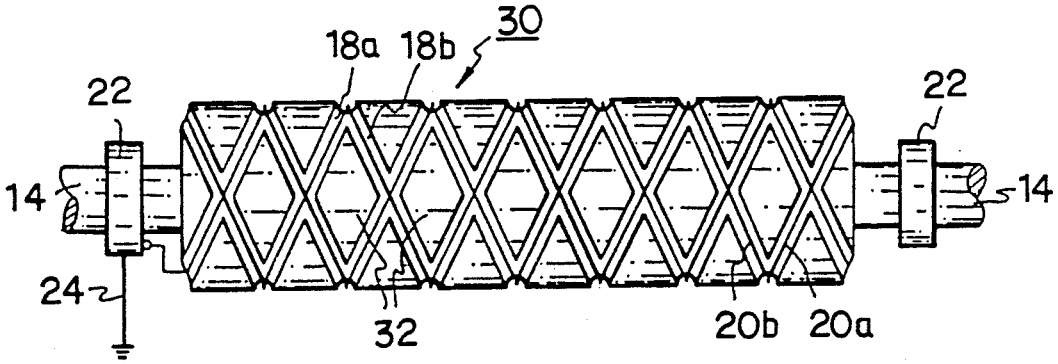
FIG. 5 is a front elevational view showing another embodiment of the antistatic composite roll in accordance with the invention.

Referring to FIG. 5, there is shown a modified embodiment of the antistatic roll in accordance with the invention. This roll 30 is functionally similar to the roll shown in FIGS. 1 to 4 but differs from each other in terms of groove pattern. Therefore, like reference numerals are used in FIG. 5 to designate like parts. Specifically, the modified roll 30 comprises an electrically nonconductive layer 16 on which a first spiral groove **18*a* and a second spiral groove 18*b* are formed to intersect one another, thereby leaving a plurality of island regions 32 of substantially rhombic configuration on the circumferential surface of the roll 30. Likewise, a first elongate conductor 20*a* and a second elongate conductor 20*b* are held within and extend along the spiral grooves 18*a* and 18*b*, respectively, to gather the electrostatic charges generated during the process of film transferring and/or winding. These conductors 20*a* and 20*b* are in contact with each other at their intersections so that an electrical connection may be made therebetween. Since the roll shown in FIG. 5 is virtually identical to the roll of FIGS. 1 to 4 with respect to both the principle of removing the static electricity and other structural details than those particularly described above, no further description will be given in this regard. Suffice it to say that the roll of FIG. 5** also employs means for grounding the elongate conductors and, optionally, a multiplicity of conductive needles attached to the elongate conductor at a substantially uniform spacing.

While the present invention has been shown and described with reference to the particular embodiments, it will be apparent to those skilled in the art that many changes and modifications may be made without departing from the spirit and scope of the invention as defined in the claims that follow.

What is claimed is:

1. An antistatic roll for use in selectively transferring and winding a continuous sheet of polymeric film, which comprises:

a cylindrical core made of an electrically conductive material, said core provided with a pair of rotational shafts, each extending away from the opposite ends of said core in an axial direction;

a layer of electrically nonconductive material surrounding said core, said nonconductive layer having a spiral groove formed on the surface thereof at a substantially equal pitch;

an elongate conductor held within and extending along said spiral groove so as to gather static electricity charged on the roll and the polymeric film; and means for grounding said elongate conductor to drain off the static electricity gathered therein.

2. The roll as recited in claim 1, which further comprises a multiplicity of conductive needles fixedly secured to and substantially uniformly spaced along said elongate conductor, each of said needles extending outwardly along the radius of said roll.

3. The roll as recited in claim 1, wherein said grounding means comprises a terminal end of said elongate conductor, a conductive bearing for rotatably supporting said roll, said bearing kept in contact with said terminal end, and a conductive wire for providing an electrical connection between said bearing and the ground.

4. An antistatic roll for use in selectively transferring and winding a continuous sheet of polymeric film, which comprises:

a cylindrical core made of an electrically conductive material, said core provided with a pair of rotational shafts, each extending away from the opposite ends of said roll in an axial direction;

a layer of electrically nonconductive material surrounding said core, said nonconductive layer having a first spiral groove provided on the surface thereof at a substantially equal pitch and a second spiral groove formed to intersect said first groove, thereby defining a plurality of substantially rhombic island regions on the surface of said roll;

a pair of elongate conductors, each held within and extending along said first and said second spiral grooves so as to gather static electricity charged on the roll and the polymeric film; and means for grounding said elongate conductors to drain off the static electricity gathered therein.

5. The roll as recited in claim 4, which further comprises a multiplicity of conductive needles fixedly secured to and substantially uniformly spaced along said elongate conductors, each of said needles extending outwardly along the radius of said roll.

* * * * *